US006109198A

United States Patent [19]

Hintz

[11] Patent Number: 6,109,198

[45] Date of Patent: Aug. 29, 2000

[54] BOAT DOCKING DEVICE

[76] Inventor: Howard Hintz, 3991 Kaiser Rd., Tecumseh, Mich. 49286

[21] Appl. No.: 09/479,047

[22] Filed: Jan. 7, 2000

[51] Int. Cl.[7] ..... B63B 21/00

[52] U.S. Cl. ..... 114/230.26; 114/230.2

[58] Field of Search ..... 114/230.2, 230.1, 114/230.26, 230.28, 230.29, 230.3, 343, 364; 440/101

[56] References Cited

U.S. PATENT DOCUMENTS 4,635,986 1/1987 Johns .
4,667,617 5/1987 Molitor .
4,676,181 6/1987 Oates, Jr. ..... 114/230
4,747,363 5/1988 MacMillan et al. ..... 114/361
4,932,700 6/1990 Hart .
5,116,260 5/1992 Upchurch .

*Primary Examiner*—Ed Swinehart
*Attorney, Agent, or Firm*—Henderson & Sturm LLP

[57] ABSTRACT

A boat docking device adapted for use in combination with a boat having an oar lock. The boat docking device includes a body member with a closed loop of flexible line and a bolt that are attached to and extend from the body member. The free end of the bolt has a number of vertically spaced annular grooves that are adapted to receive a locking spring pin. In use, the closed loop is placed over a dock post, the bolt is inserted in the sleeve of the oar lock with the free end extending below the sleeve, and the spring pin is attached to the groove closest to the bottom of the oar lock.

6 Claims, 2 Drawing Sheets

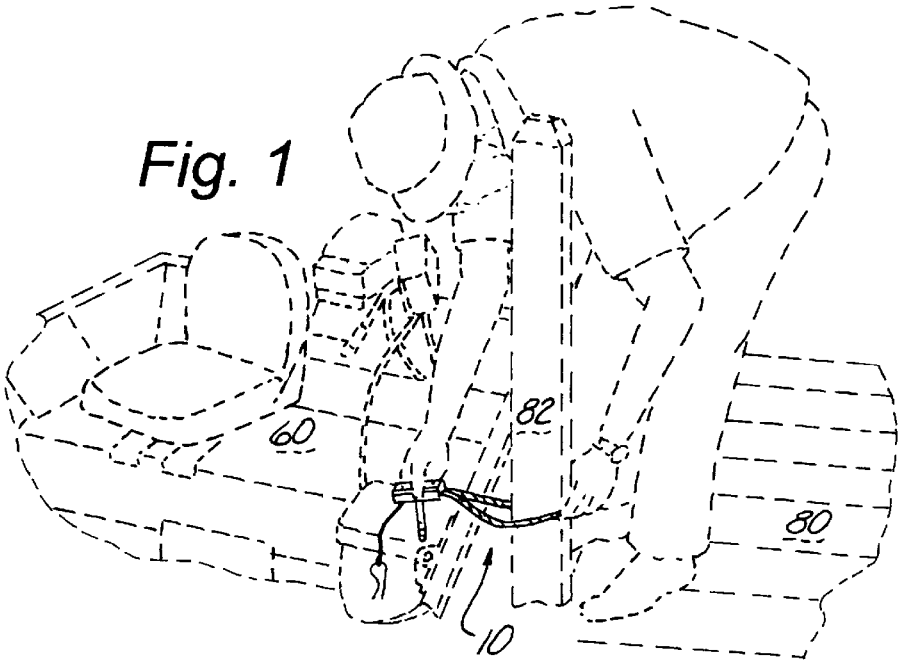
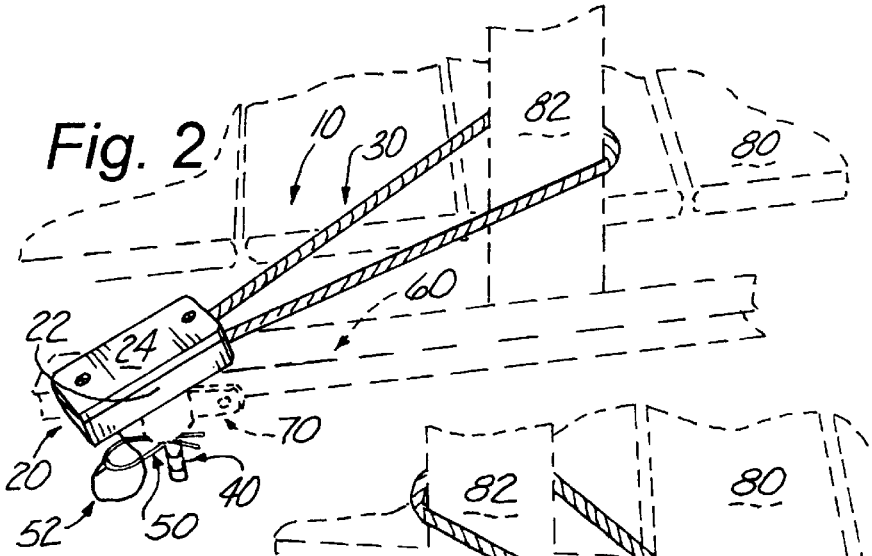
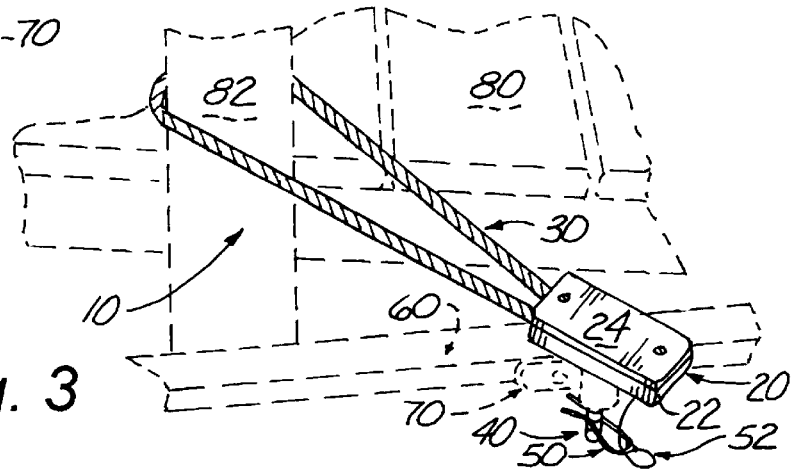
Fig. 3

Fig. 4
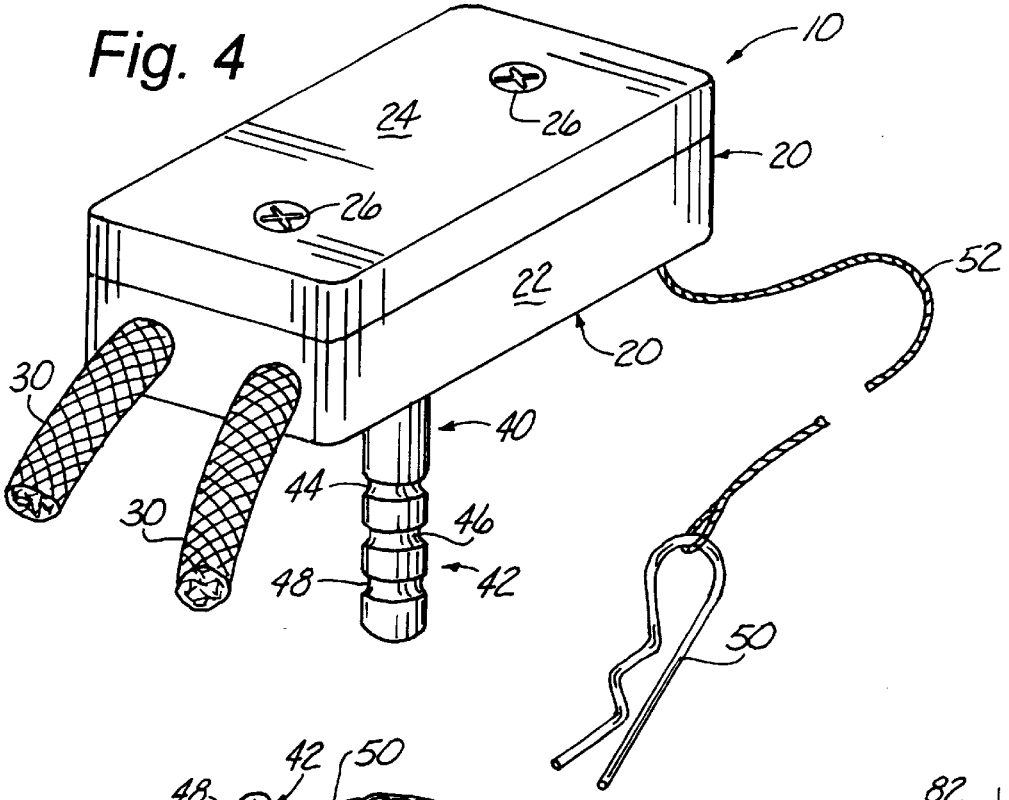
Fig. 5
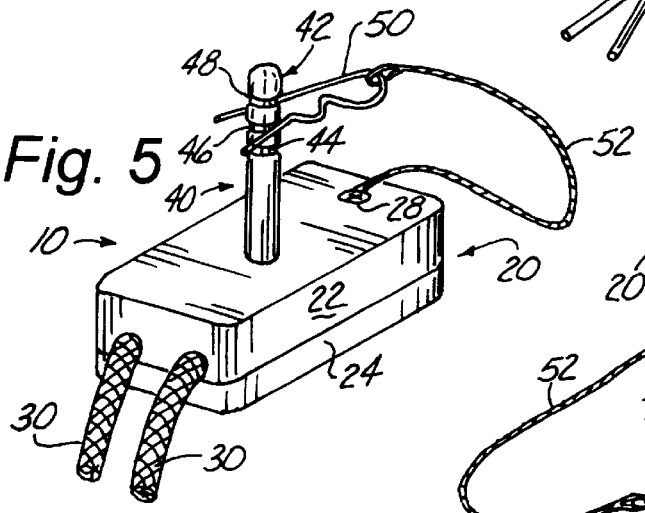
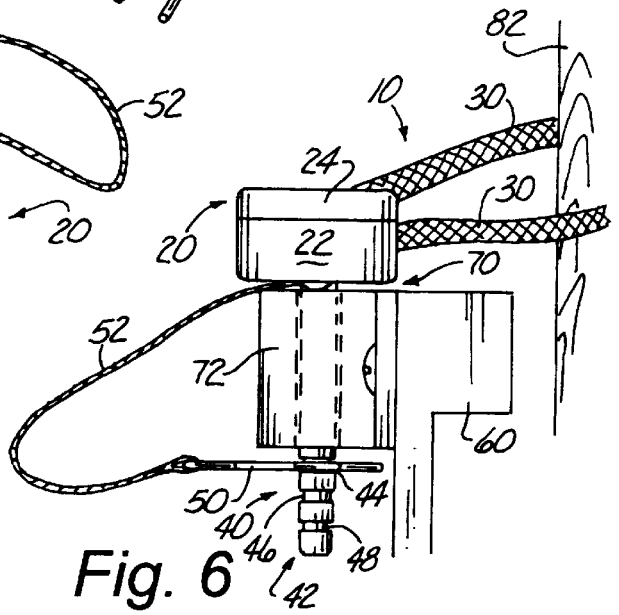
Fig. 6

BOAT DOCKING DEVICE

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of boating accessories, and more particularly to a boat docking device.

2. Description of Related Art

As can be seen by reference to the following U.S. Pat. Nos. 4,635,986; 4,667,617; 4,932,700 and 5,116,260 the prior art is replete with myriad and diverse boating devices.

While all of the aforementioned prior art constructions are more than adequate for the basic purpose and function for which they have been specifically designed, they are uniformly deficient with respect to their failure to provide a simple, efficient, and practical boat docking device.

As a consequence of the foregoing situation, there has existed a longstanding need for a new and improved boat docking device and the provision of such a construction is a stated objective of the present invention.

BRIEF SUMMARY OF THE INVENTION

Briefly stated, the present invention provides a boat docking device adapted for use in combination with a boat having an oar lock. The boat docking device includes a body member with a closed loop of flexible line and a bolt that are attached to and extend from the body member. The free end of the bolt has a number of vertically spaced annular grooves that are adapted to receive a locking spring pin. In use, the closed loop is placed over a dock post, the bolt is inserted in the sleeve of the oar lock with the free end extending below the sleeve, and the spring pin is attached to the groove closest to the bottom of the oar lock.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein:

FIG. 1 is a perspective view showing the boat docking device of the present invention;

FIG. 2 is an enlarged right side perspective view showing the docking device attached to the oar lock of a boat;

FIG. 3 is an enlarged left side perspective view thereof;

FIG. 4 is a greatly enlarged partial perspective view of the docking device;

FIG. 5 is a partial perspective view of the underside of the docking device; and FIG. 6 is a side elevational view showing the docking device secured in the sleeve of the oar lock by the engagement of the locking spring pin in one of the annular grooves in the free end of the bolt.

DETAILED DESCRIPTION OF THE INVENTION

As can be seen by reference to the drawings, and in particularly to FIG. 1, the boat docking device that forms the basis of the present invention is designated generally by the reference number 10. The boat docking device 10 includes a body member 20 formed of a base 22 and a cap 24 secured to the base 22 by fasteners 26. The base 22 is adapted to receive a closed loop 30 of flexible line, such as nylon rope, and a bolt 40. The cap 24 covers the base 22 to secure the line 30 and bolt 40 therein.

As best shown in FIGS. 4–6, the bolt 40 has a free end 42 that carries a number of vertically spaced, annular grooves 44, 46, 48. A locking spring pin 50 is attached to the base 22 by a tether 52 and a fastener 28. The pin 50 is adapted to engage a selected one of the grooves 44, 46, 48 as shown in FIG. 6.

The docking device 10 is used in combination with prams and small boats 60 that have oar locks 70, including a bolt receiving sleeve 72. In use, when putting the boat 60 in the water from a trailer or when docking, the boat 60 is positioned near the dock 80 and the closed loop 30 is placed over a dock post 82. The bolt 40 is inserted in the sleeve 72 of the oar lock 70 so that the free end 42 and at least one of the annular grooves 44, 46, 48 extends below the sleeve 72. The locking spring pin 50 is then placed to engage the one of the grooves 44, 46, 48 closest to the bottom of the sleeve 72. The boat 60 is thus quickly and easily secured to the dock post 82 in a matter of seconds.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

What is claimed is:

1. A boat docking device for use in combination with a boat having an oar lock including a bolt receiving sleeve, the boat docking device comprising:

a body member;

a flexible line attached to and extending from the body member to form a closed loop; and a bolt attached to and extending from the body member, the bolt being disposed to be selectively received into the sleeve of the oar lock.

2. The boat docking device of claim 1 wherein the bolt includes a free end having an annular groove formed therein, wherein the free end extends through and below the sleeve, and wherein the device further includes a locking spring pin disposed to selectively engage the groove when the bolt extends below the sleeve.

3. The boat docking device of claim 2 wherein the spring pin is attached to the body member by a tether.

4. The boat docking device of claim 2 wherein the free end of the bolt has a plurality of vertically spaced annular grooves, and wherein the spring pin is disposed to selectively engage one of the annular grooves.

5. The boat docking device of claim 1 wherein the flexible line is a nylon rope.

6. The boat docking device of claim 1 wherein the body member includes a base disposed to receive the flexible line and the boat, and a cap disposed to cover the base and secure the flexible line and bolt in the base.

* * * * *